US007158739B2

(12) United States Patent
Ohara et al.

(10) Patent No.: US 7,158,739 B2
(45) Date of Patent: Jan. 2, 2007

(54) IMAGE FORMING APPARATUS CAPABLE OF STABLE WIRELESS COMMUNICATION

(75) Inventors: Koji Ohara, Toyokawa (JP); Takeshi Nomura, Toyohashi (JP); Fumio Maekawa, Hoi-gun (JP); Kunio Furukawa, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 103 days.

(21) Appl. No.: 11/017,668

(22) Filed: Dec. 22, 2004

(65) Prior Publication Data

US 2006/0067738 A1 Mar. 30, 2006

(30) Foreign Application Priority Data

Sep. 27, 2004 (JP) ..... 2004-279935

(51) Int. Cl.
*G03G 15/01* (2006.01)

(52) U.S. Cl. ..... 399/227

(58) Field of Classification Search ..... None
See application file for complete search history.

(56) References Cited

U.S. PATENT DOCUMENTS

2005/0105920 A1* 5/2005 Matsunaga ..... 399/1

FOREIGN PATENT DOCUMENTS

JP 11-316534 11/1999

* cited by examiner

*Primary Examiner*—Quana Grainger
(74) *Attorney, Agent, or Firm*—Buchanan Ingersoll & Rooney PC

(57) ABSTRACT

In an image forming operation, communication with a non-contact type data storage circuit is established by a communication signal of a first percentage modulation, and when not in an image forming operation, communication with a non-contact type data storage circuit is established by a communication signal of a second percentage modulation smaller than the first percentage modulation.

10 Claims, 7 Drawing Sheets

505
230C 505
230C 505
230C

IMAGE FORMING APPARATUS CAPABLE OF STABLE WIRELESS COMMUNICATION

This application is based on Japanese Patent Application No. 2004-279935 filed with the Japan Patent Office on Sep. 27, 2004, the entire content of which is hereby incorporated by reference.

BACKGROUND OF THE INVENTION

1. Field of the Invention

The present invention relates to an image forming apparatus and, more specifically, to an image forming apparatus that can data-access to a non-contact type data storage circuit mounted on a detachable unit in the image forming apparatus.

2. Description of the Related Art

In 4-cycle type color printers including one photoreceptor drum and four developing units for forming a toner image on the photoreceptor drum, it is currently a dominant trend to provide a non-contact type IC memory on the developing unit. The non-contact type IC memory stores information related to the developing unit (in the following, also referred to as developing unit information). The developing unit information includes an ID code, serial number, date of manufacturing, lot number, cartridge identifying information, color information, toner consumption and so on.

Generally, in a 4-cycle type color printer, in a step in which a latent electro-static image is formed on the surface of photoreceptor drum and toner is attracted to the latent electrostatic image, a high-voltage AC signal is generated internally. If a data access to the non-contact type IC memory (hereinafter also referred to as a wireless communication process) takes place in the period in which the high-voltage AC signal is generated internally (hereinafter also referred to as a high-voltage generating period), it is likely that the high-voltage AC signal hinders normal data-access to the non-contact type IC memory.

In view of the foregoing, Japanese Laid-Open Patent Publication No. 11-316534 discloses a technique that reduces the influence of high-voltage AC signal mentioned above, by preventing the radio frequency used at the time of wireless communication process from becoming a multiple of the frequency of high-voltage AC signal.

According to the technique disclosed in Japanese Laid-Open Patent Publication No. 11-316534, however, the radio frequency of the signal used for the wireless communication process possibly becomes a multiple of the frequency of high-voltage AC signal because of circuit characteristic variations and temperature conditions, and therefore, possible influence of the high-voltage AC signal remains.

In the 4-cycle type color printer, the four developing units are provided on one developing rack, which rack rotates. Therefore, the non-contact type IC memory attached to the developing unit also rotates. Therefore when a large amount of data is to be transmitted/received to and from the non-contact type IC memory that rotates, the wireless communication process could fail unless the time for wireless communication is made longer correspondingly.

SUMMARY OF THE INVENTION

An object of the present invention is to provide an image forming apparatus capable of stable wireless communication process even when a high-voltage is being generated.

Another object of the present invention is to provide an image forming apparatus that can ensure longer time for wireless communication process.

In order to attain the above-described objects, according to an aspect, the present invention provides an image forming apparatus including: a unit that moves along with an image forming operation for forming an image; a non-contact type data storage circuit provided corresponding to the unit and moving with the unit; and a communication control portion communicating with the non-contact type data storage circuit and controlling data-access to the non-contact type data storage circuit; wherein the communication control portion communicates with the non-contact type data storage circuit with a communication signal having a first percentage modulation during an image forming operation, and communicates with the non-contact type data storage circuit with a communication signal having a second percentage modulation smaller than the first percentage modulation not during the image forming operation, so as to attain data-access to the non-contact type data storage circuit.

Preferably, the image forming apparatus further includes an image forming voltage-generating portion generating an image forming voltage and the unit includes a developing member for forming an image utilizing the image forming voltage in an image forming operation.

Preferably, the unit moves not in the image forming operation, and stops at a prescribed position in the image forming operation.

Preferably, the image forming apparatus further includes a communication determining portion determining whether communication of an amount of data is possible or not based on a communication process time calculated from the amount of data communicated between the communication control portion and the non-contact type data storage circuit and an available communication time calculated based on the speed of movement of the non-contact type data storage circuit; and when the communication determining portion determines that a communication is possible, the communication control portion communicates with the non-contact type data storage circuit by said communication signal of the second percentage modulation, to attain data-access to the non-contact type data storage circuit.

Preferably, the communication signal is an amplitude-modulated signal.

Preferably, the first percentage modulation is 100% and the second percentage modulation is 10%.

According to another aspect, the present invention provides an image forming apparatus including: a unit that moves along with an image forming operation for forming an image; a non-contact type data storage circuit provided corresponding to the unit and moving with the unit; a communication control portion communicating with the non-contact type data storage circuit and controlling data-access to the non-contact type data storage circuit; and a high-voltage supplying portion supplying a high-voltage for forming an image; wherein the communication control portion communicates with the non-contact type data storage circuit by a communication signal of a first percentage modulation when the high-voltage supplying portion is supplying a high-voltage to the unit, and communicates with the non-contact type data storage circuit by a communication signal of a second percentage modulation smaller than the first percentage modulation when the high-voltage supplying portion does not supply any high-voltage to the unit, so as to attain data-access to the non-contact type data storage circuit.

Preferably, the communication signal is an amplitude-modulated signal.

Preferably, the first percentage modulation is 100% and the second percentage modulation is 10%.

According to a still another aspect, the image forming apparatus with a plurality of developing units corresponding to a plurality of colors for forming a color image includes: a developing apparatus moving each of the developing units for successively stopping the developing units at prescribed image forming positions respectively; a non-contact type IC memory provided corresponding to each developing unit and moving along with the movement of the developing unit; a high-voltage supplying portion supplying a high-voltage for development to a stopped developing unit that is the developing unit stopped at the image forming position when any of the plurality of developing units is stopped at the image forming position; a communication portion provided to be close to the non-contact type IC memory provided corresponding to the stopped developing unit; and a communication control portion controlling communication such that when a high-voltage is being applied by the high-voltage supplying portion to the stopped developing unit, communication with the non-contact IC memory is established by a communication signal of a first percentage modulation using the communication portion and when a high-voltage is not being applied by the high-voltage supplying portion to the stopped developing unit, communication with the non-contact IC memory is established by a communication signal of a second percentage modulation smaller than the first percentage modulation, using the communication portion.

Therefore, according to the present invention, in the image forming operation, communication is established by a communication signal of the first percentage modulation larger than the second percentage modulation, whereby a stable wireless communication becomes possible.

Not in the image forming operation, communication with the moving non-contact type data storage circuit is established by a communication signal of a second percentage modulation smaller than the first percentage modulation, and therefore, the moving non-contact type data storage circuit can be detected earlier, and longer time for wireless communication can be ensured.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
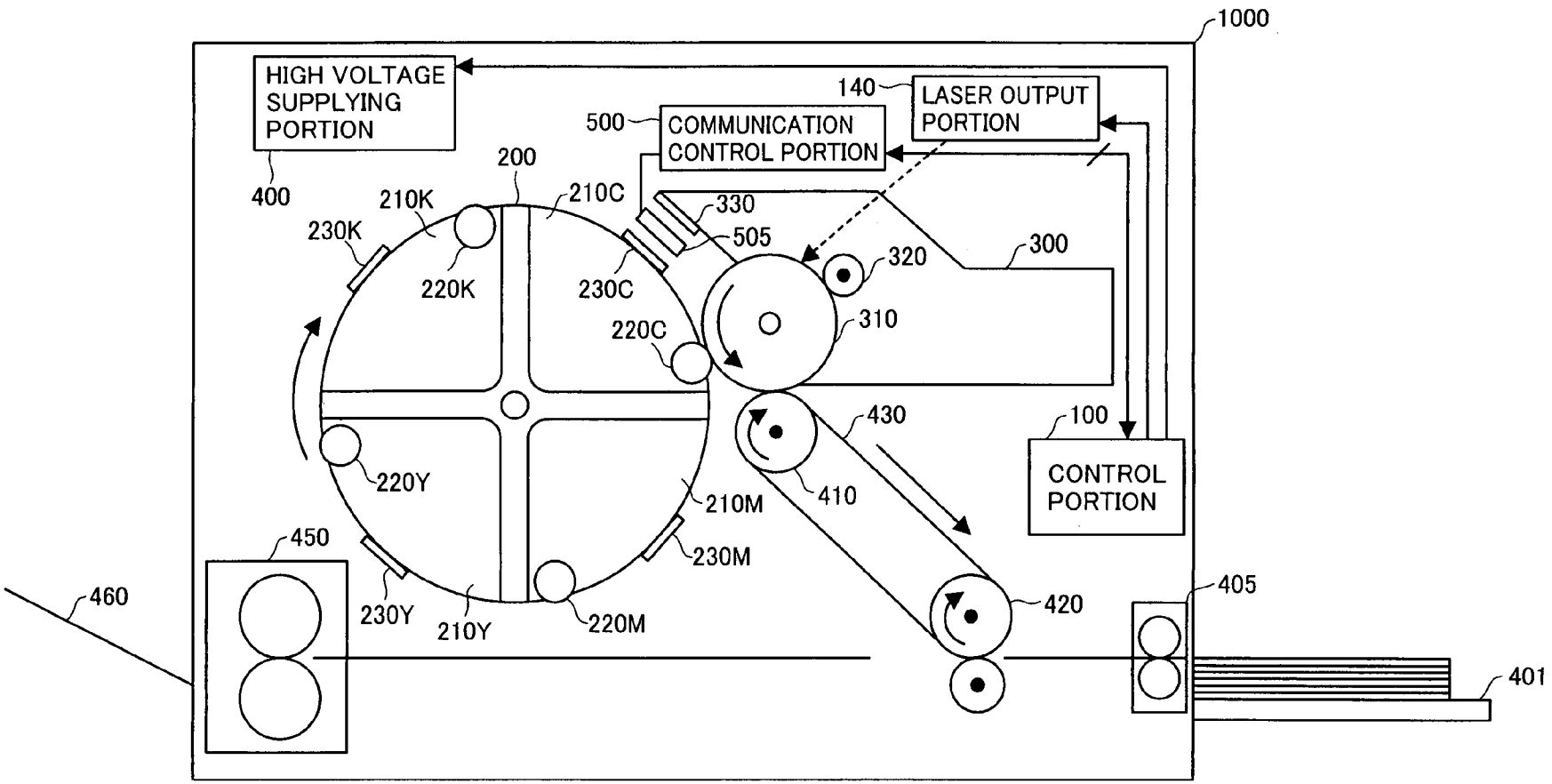
FIG. 1 is a cross-sectional view showing a schematic configuration of an image forming apparatus in accordance an embodiment.

In the following, embodiments of the present invention will be described with reference to the figures. In the following description, same portions are denoted by the same reference characters, and their names and functions are also the same. Therefore, detailed description thereof will not be repeated.

FIG. 1 is a cross-sectional view showing a schematic configuration of an image forming apparatus 1000 in accordance with an embodiment. Image forming apparatus 1000 in accordance with the present embodiment is a 4-cycle type color printer.

Referring to FIG. 1, image forming apparatus 1000 includes a developing rack 200, a photoreceptor unit 300, a control portion 100, a high-voltage supplying portion 400, and a laser output portion 140. Developing rack 200 rotates clockwise.

Developing rack 200 includes developing units 210C, 210M, 210Y, and 210K. The developing rack will also be referred to as a developing apparatus.

Developing unit 210C has cyan (C) toner. Developing unit 210M has magenta (M) toner. Developing unit 210Y has yellow (Y) toner. Developing unit 210K has black (K) toner. Here, developing units 210C, 210M, 210Y and 210K as well as photoreceptor unit 300 are formed as cartridges, to allow exchange by the user.

Developing unit 210C has a developing member 220C. Developing unit 210M has a developing member 220M. Developing unit 210Y has a developing member 220Y. Developing unit 210K has a developing member 220K. In the following, developing members 220C, 220M, 220Y and 220K will be also generally referred to as a developing member 220.

Photoreceptor unit 300 includes a photoreceptor drum 310 and a charger 320. Photoreceptor drum 310 rotates counterclockwise.

Control portion 100 has a function of controlling developing rack 200, high-voltage supplying portion 400 and laser output portion 140.

Developing rack 200 rotates and stops, controlled by control portion 100. As development rack 200 rotates clockwise, developing units 210C, 210M, 210Y and 210K provided on developing rack 200 also rotate clockwise, as developing rack 200 rotates. As developing units 210C, 210M, 210Y and 210K rotate clockwise, developing members 220C, 220M, 220Y and 220K of developing unit 210C, 210M, 210Y and 210K also rotate clockwise.

High-voltage supplying unit 400 applies a high-voltage to charger 320 under the control of control portion 100. The high-voltage applied by high-voltage supplying portion 400 is for forming an image (hereinafter also referred to as an image forming voltage), and therefore, the high-voltage supplying portion will also be referred to as an image forming voltage generating portion.

When the high-voltage is applied from high-voltage supplying portion 400, charger 320 charges the surface of photoreceptor drum 310 that rotates counterclockwise. In the following, the process of charging the surface of photoreceptor drum 310 will also be referred to as a charging process.

Laser output portion 140 irradiates the charged surface of photoreceptor drum 310 with a laser beam under the control of control portion 100, whereby a latent electrostatic image is formed. In the following, the process of forming a latent electrostatic image on the surface of photoreceptor drum 310 is also referred to as a latent electro-static image forming process. The latent electro-static image forming process is performed color by color successively, that is, for each of C, M, Y and K that form a color image. Control portion 100 rotates developing rack 200 for each latent electro-static image forming process of C, M, Y and K, so that the developing rack 200 of the corresponding color is successively stopped at a position (hereinafter also referred to as an image forming position) closest to photoreceptor drum 310.

High-voltage supplying portion 400 applies a high voltage to developing members 220C, 220M, 220Y and 220K under the control of control portion 100. Specifically, high-voltage supplying portion 400 applies a high voltage to developing member 220, when developing member 220 stops at the image forming position under the control of control portion 100.

As the high-voltage (developing bias voltage) is applied, the charged toner is adhered on the surface, on which the latent electro-static image has been formed, of photoreceptor drum 310 rotating clockwise. Consequently, a toner image is formed on the surface of photoreceptor drum 310. In the following, the process of forming the toner image on the surface of photoreceptor drum 310 will also be referred to as a toner image forming process. The toner image forming process is performed successively for each of developing members 220C, 220M, 220Y and 220K. Specifically, on the surface of photoreceptor drum 310, toner images of respective colors are formed successively.

Image forming apparatus 1000 further includes an intermediate transfer belt 430, rollers 410 and 420, a paper feed tray 401, a paper feed portion 405, a fixer 450, and a paper discharge tray 460. Rollers 410 and 420 rotate clockwise.

Intermediate transfer belt 430 rotates clockwise, because of the rotating operation of rollers 410 and 420. As intermediate transfer belt 430 rotates, the toner image formed on the surface of photoreceptor drum 310 is transferred onto intermediate transfer belt 430. In the following, the process of transferring the toner image formed on the surface of photoreceptor drum 310 to the surface of intermediate transfer belt 430 will also be referred to as the intermediate transfer process. The operation of transferring the toner image onto the intermediate transfer belt 430 is performed for each of C, M, Y and K.

On the surface of intermediate transfer belt 430, the toner images of C, M, Y and K are formed one by one every time intermediate transfer belt 430 rotates once. Therefore, when intermediate transfer belt 430 has rotated four times, all toner images of C, M, Y and K (hereinafter also referred to as a color image) have been formed overlapped with each other on the surface of intermediate transfer belt 430.

Paper feed tray 401 holds a sheet of paper on which the color image is to be transferred.

Paper feed portion 405 feeds the sheet of paper held by paper feed tray 401 to roller 420 that rotates intermediate transfer belt 430.

The color image that has been formed on the surface of intermediate transfer belt 430 is transferred to the sheet of paper fed from paper feed portion 405 by the rotating operation of roller 420. In the following, the process in which the color image formed on the surface of intermediate transfer belt 430 is transferred to the sheet of paper will also be referred to as a transfer process. Further, the sheet of paper on which the color image has been transferred is also referred to as an image transferred sheet of paper. The image transferred sheet of paper is fed to fixer 450 by the operation of roller 420.

High-voltage supplying portion 400 also applies the high voltage to fixer 450, under the control of control portion 100.

As the high voltage is applied by high-voltage supplying portion 400, fixer 450 melts the toner on the surface of the image transferred sheet of paper fed thereto, while pressing the image transferred sheet of paper with the roller, whereby the toner is fixed on the sheet of paper. Thereafter, fixer 450 feeds the toner-fixed sheet of paper to discharge tray 460.

By the above-described operation, a color image can be copied onto the sheet of paper.

On the surfaces of developing units 210C, 210M, 210Y and 210K, non-contact type IC memories 230C, 230M, 230Y and 230K are attached. In the following, non-contact type IC memories 230C, 230M, 230Y and 230K will be generally referred to as non-contact type IC memory 230. The IC memory has a circuit for storing data, and therefore, the non-contact type IC memory is also referred to as a non-contact type data storage circuit.

Developing units 210C, 210M, 210Y and 210K rotate clockwise, and therefore, non-contact type IC memories 230C, 230M, 230Y and 230K also rotate clockwise.

Non-contact type IC memories 230C, 230M, 230Y and 230K allow storage and reading of information of the developing unit through wireless data access. The developing unit information includes an ID code, serial number, date of manufacturing, lot number, cartridge identifying information, color information, toner consumption, whether the developing unit is a new unit or not, and information of the number of recycled use of the developing unit.

On the surface of photoreceptor unit 300, a non-contact type IC memory 330 is mounted. Non-contact type IC memory 330 is a memory that allows storage and reading of information related to the photoreceptor unit through wireless data access.

Image forming apparatus 1000 further includes a communication control portion 500 and an antenna 505. Communication control portion 500 performs wireless communication with non-contact type IC memory 230 utilizing antenna 505 functioning as communicating means, under the control of control portion 100. Antenna 505 is connected to communication control portion 500.

Figure 2:
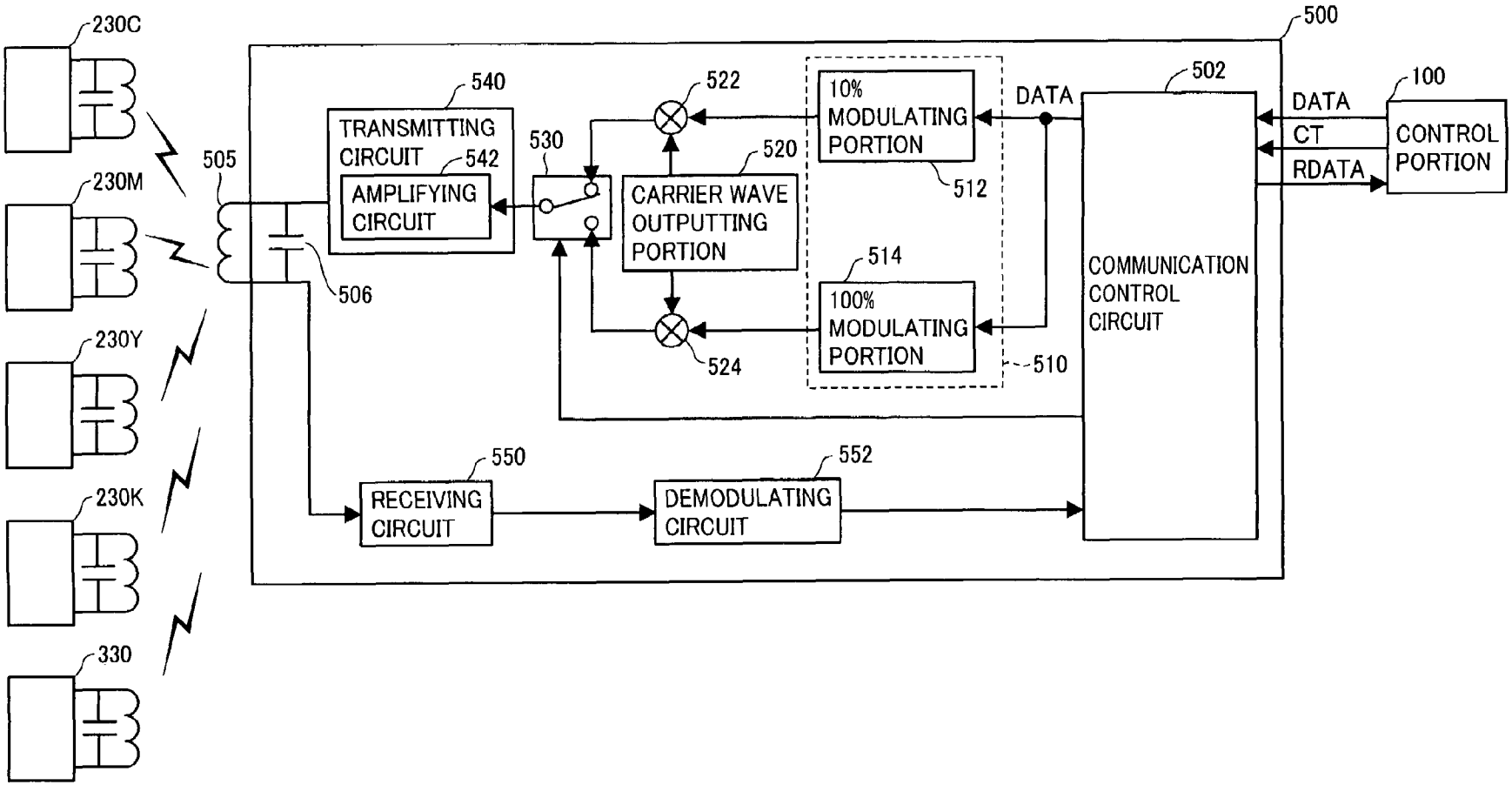
FIG. 2 is a block diagram showing an internal configuration of a communication control portion.

FIG. 2 is a block diagram representing an internal configuration of communication control portion 500. In FIG. 2, control portion 100 and antenna 505 connected to communication control portion 500, and non-contact type IC memories 230C, 230M, 230Y, 230K and 330 are also shown.

Referring to FIG. 2, communication control portion 500 includes a communication control circuit 502, a modulator 510, a carrier wave outputting portion 520, signal superposing portions 522 and 524, and an output signal switching circuit 530.

By way of example, control portion 100 transmits to communication control circuit 502, data signal DATA including the developing unit information, and a control signal CT for controlling communication control circuit 502.

Communication control circuit 502 performs a prescribed control as will be described later, in response to control signal CT. Further, communication control circuit 502 outputs the data signal DATA received from control portion 100 to modulator 510.

Modulator 510 includes a modulating portions 512 and 514.

Modulating portion 512 performs amplitude modulation of 10% on the data signal DATA output from communication control circuit 502, and outputs the result to signal superposing portion 522. Modulating portion 514 performs amplitude modulation of 100% on the data signal DATA output from communication control circuit 502, and outputs the result to signal superposing portion 524.

Carrier wave outputting portion 520 outputs a carrier wave to signal superposing portions 522 and 524.

Signal superposing portion 522 outputs a signal obtained by superposing the signal output from modulating portion 512 and the carrier wave output from carrier wave output portion 520 (hereinafter also referred to as a 10% modulated communication signal) to output signal switching circuit 530. Signal superposing portion 524 outputs a signal obtained by superposing the signal output from modulating potion 514 and the carrier wave output from carrier wave output portion 520 (hereinafter also referred to as a 100% modulated communication signal) to output signal switching circuit 530.

Figure 3B:
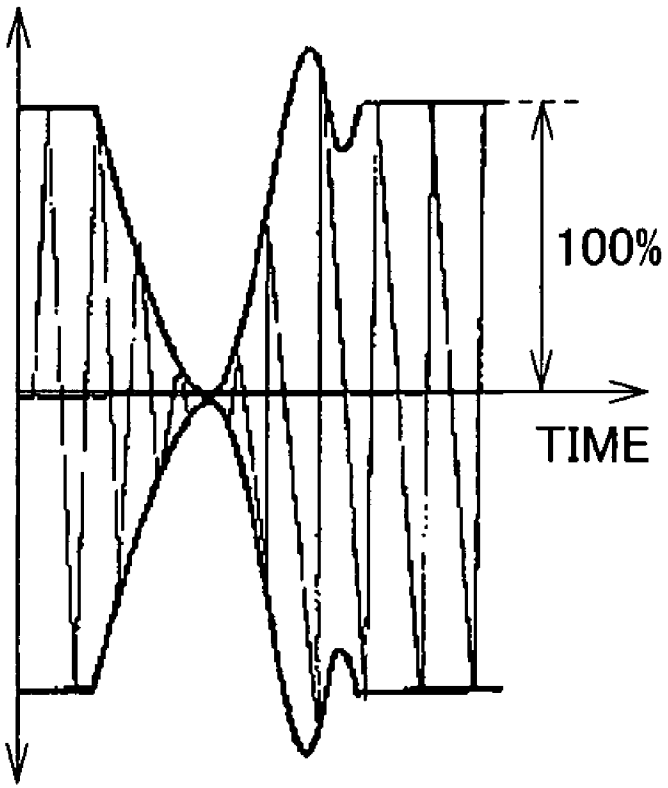
FIGS. 3A and 3B are waveform diagrams showing amplitude-modulated signals with a carrier wave superposed.
Figure 3A:
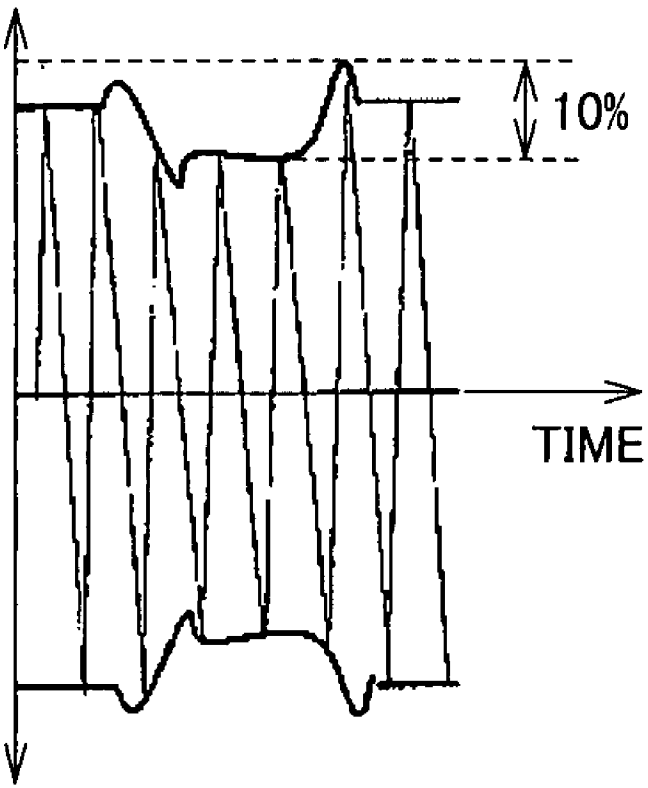

FIG. 3 shows the waveforms of the amplitude-modulated signals superposed with the carrier wave. FIG. 3(A) represents the waveform of 10% modulated communication signal, and FIG. 3(B) represents the waveform of 100% modulated communication signal.

The 10% modulated communication signal has longer communication distance than 100% modulated communication signal, but it is more susceptible to noise, as it has smaller amplitude difference than the 100% modulated communication signal. In the following, the 10% modulated communication signal will also be referred to as a long distance signal.

The 100% modulated communication signal has shorter communication distance than the 10% modulated communication signal, but it is stronger against noise as it has larger amplitude difference than the 10% modulated communication signal. In the following, the 100% modulated communication signal will also be referred to as a short distance signal.

The long distance and short distance signals are in compliance with ISO18000-3 (ISO15693, ISO14443) standard, that is, standard for infra-red communication. In the present embodiment, the long distance and short distance signals are not limited to ISO18000-3 (ISO15693, ISO14443) standard, and these signals may be in compliance with standard for other wireless communication system (such as IrDA (Infrared Data Association) standard).

Again referring to FIG. 2, communication control portion 500 further includes a transmitting circuit 540, a capacitor 506, a receiving circuit 550 and a demodulating circuit 552.

Communication control circuit 502 controls output signal switching circuit 530 such that either the long distance signal or the short distance signal input to output signal switching circuit 530 is output to transmitting circuit 540.

Transmitting circuit 540 has an amplifying circuit 542. Amplifying circuit 542 is an A-class or AB-class amplifying circuit. Amplifying circuit 542 is not limited to the A-class or AB-class amplifying circuit, and it may be a circuit of other type that has small distortion at the time of amplification.

Amplifying circuit 542 amplifies the long distance signal or the short distance signal output from output signal switching circuit 530, and outputs the result to antenna 505.

Antenna 505 is formed of a coil. Antenna 505 and capacitor 506 form a resonant circuit. The resonant circuit is connected to transmitting circuit 540 and receiving circuit 550. Transmitting circuit 540 transmits the signal output from output signal switching circuit 530 to non-contact type IC memories 230C, 230M, 230Y and 230K as well as 330 as a long distance signal or short distance signal, using antenna 505.

Figure 4:
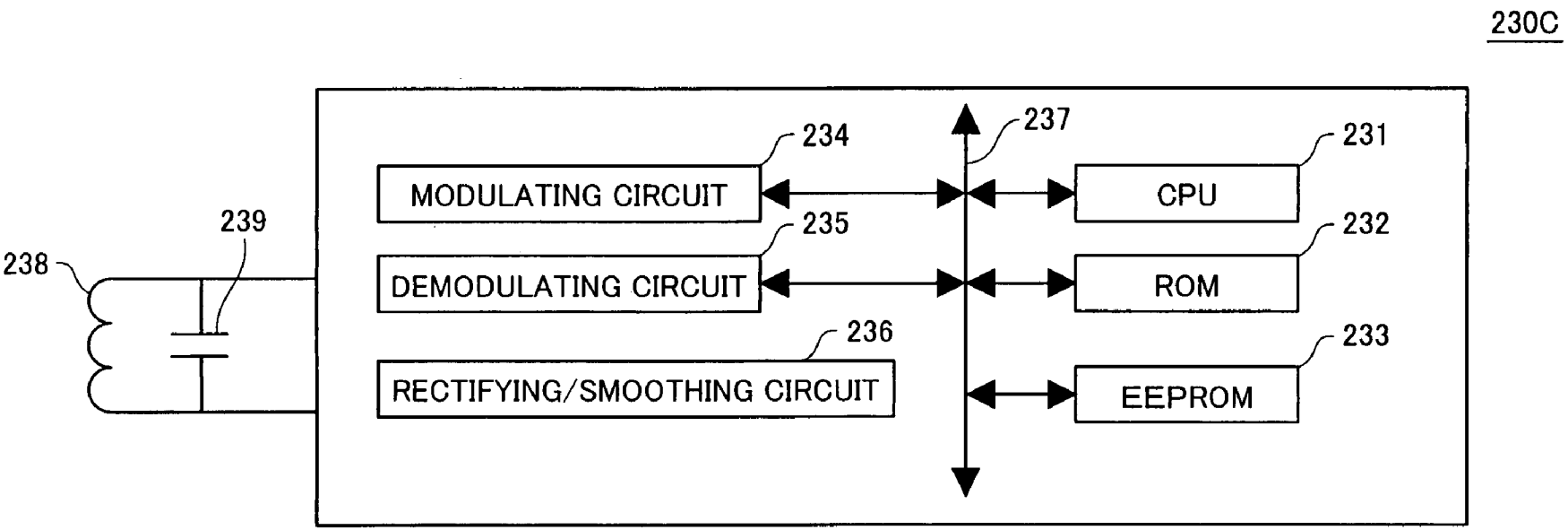
FIG. 4 is a block diagram showing an internal configuration of a non-contact type IC memory.

FIG. 4 is a block diagram showing an internal configuration of a non-contact type IC memory.

Referring to FIG. 4, non-contact type IC memory 230C includes an antenna 238, a capacitor 239, a CPU 231, an ROM (Read Only Memory) 232, an EEPROM (Electrically Erasable and Programmable Read Only Memory) 233, a modulating circuit 234, a demodulating circuit 235, a rectifying/smoothing circuit 236, and a bus 237. CPU 231, ROM 232, EEPROM 233, modulating circuit 234 and demodulating circuit 235 are connected to bus 237, and exchange data to and from bus 237.

Though an EEPROM is used as a memory for storing data in non-contact type IC 230C in the present invention, it is not limited thereto, and any other memory circuit having a structure that can store and retain data in non-volatile manner may be used in place of the EEPROM.

Antenna 238 is formed of a coil. Antenna 238 and capacitor 239 form a resonant circuit.

Antenna 238 receives the long distance signal or the short distance signal transmitted from antenna 505, and outputs the same to rectifying/smoothing circuit 236 and demodulating circuit 235.

Rectifying/smoothing circuit 236 smoothes the input signal to have a constant voltage, and supplies the voltage to CPU 231, ROM 232 and EEPROM 233. In other words, non-contact type IC memory 230C obtains an operation power from the received signal.

Demodulating circuit 235 demodulates the input signal.

ROM 232 has a control program recorded thereon, for controlling CPU 231.

CPU 231 performs a prescribed process in accordance with the signal demodulated by demodulating circuit 235. When CPU 231 determines that the demodulated signal is a data signal including the developing unit information, in the prescribed process, CPU 231 has EEPROM 233 store the data of the developing unit information. Further, in the prescribed process, CPU 231 reads the data stored in EEPROM 233 and outputs the same to modulating circuit 234.

By a control program, CPU 231 determines the percentage modulation of the signal received by antenna 238, and applies a percentage modulation instruction for generating a signal of the same percentage modulation as the signal received by antenna 238, to modulating circuit 234 when a signal is to be output. In response to the percentage modulation instruction from CPU 231, modulating circuit 234 generates a signal of the desired percentage modulation. The signal modulated by modulating circuit 234 is transmitted to the outside through antenna 238.

Again referring to FIG. 2, non-contact type IC memories 230M, 230Y, 230K and 330 have similar configuration and function to non-contact type IC memory 230C as described above, and therefore, detailed description thereof will not be repeated.

The receiving circuit 550 amplifies the signal output from any of non-contact type IC memories 230C, 230M, 230Y, 230K and 330, and outputs the result to demodulating circuit 552.

Demodulating circuit 552 demodulates the signal output from receiving circuit 550 and outputs the result to communication control circuit 502.

Communication control circuit 502 transmits the signal output from demodulating circuit 552 as received data RDATA to control portion 100. The process from reception of the signal from non-contact type IC memory 230 by communication control circuit 502 to transmission of the same to control portion 100 described above will be also referred to as a signal receiving process.

By the process described above, data communication between control portion 100 and non-contact type IC memory 230 becomes possible. Thus, control portion 100 is capable of writing data to non-contact type IC memory 230 and reading data stored in non-contact type IC memory 230.

Figures 5A, 5B, 5C:
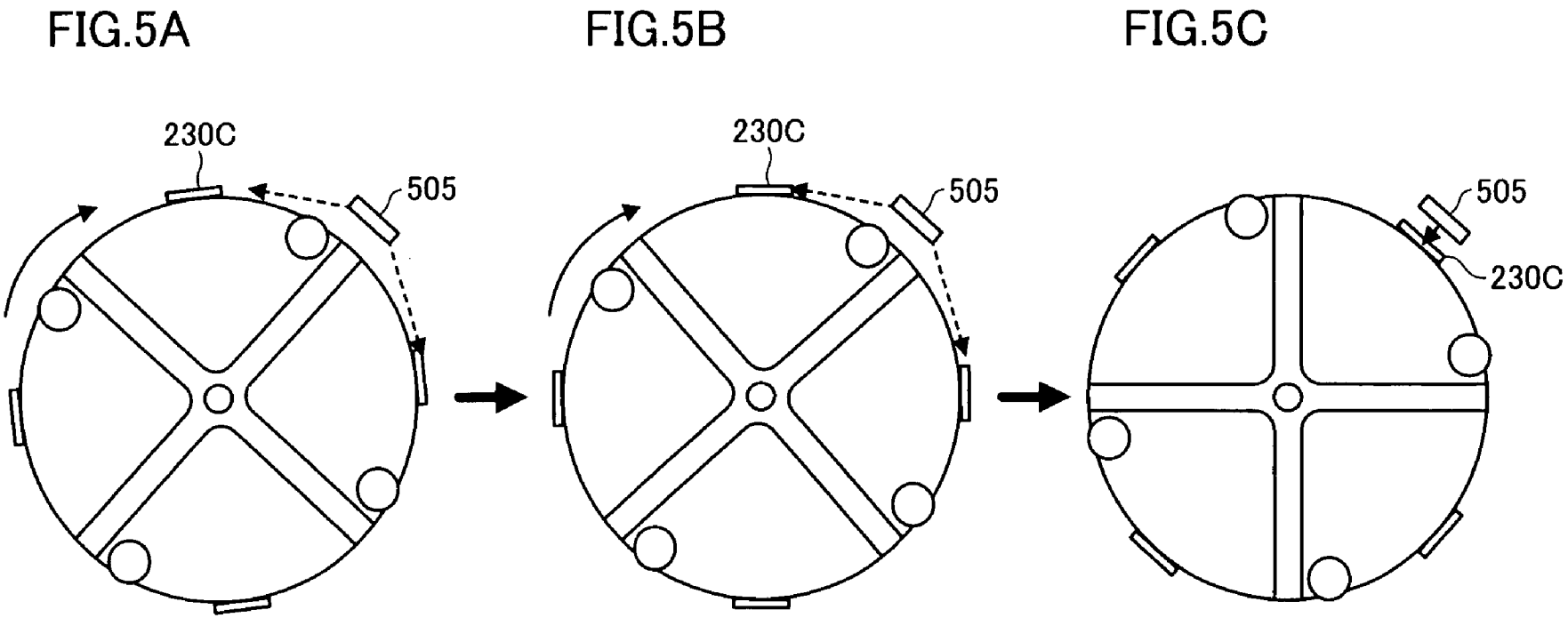
FIGS. 5A, 5B and 5C represent states of the developing rack while wireless communication is being performed between the non-contact IC memory and the antenna.

FIG. 5(A) shows a state in which non-contact type IC memory 230C is not detected by wireless communication.

FIG. 5(B) shows a state in which non-contact type IC memory 230C is detected by wireless communication.

FIG. 5(C) shows a state in which data-access to non-contact IC memory 230C is being performed.

Figure 6:
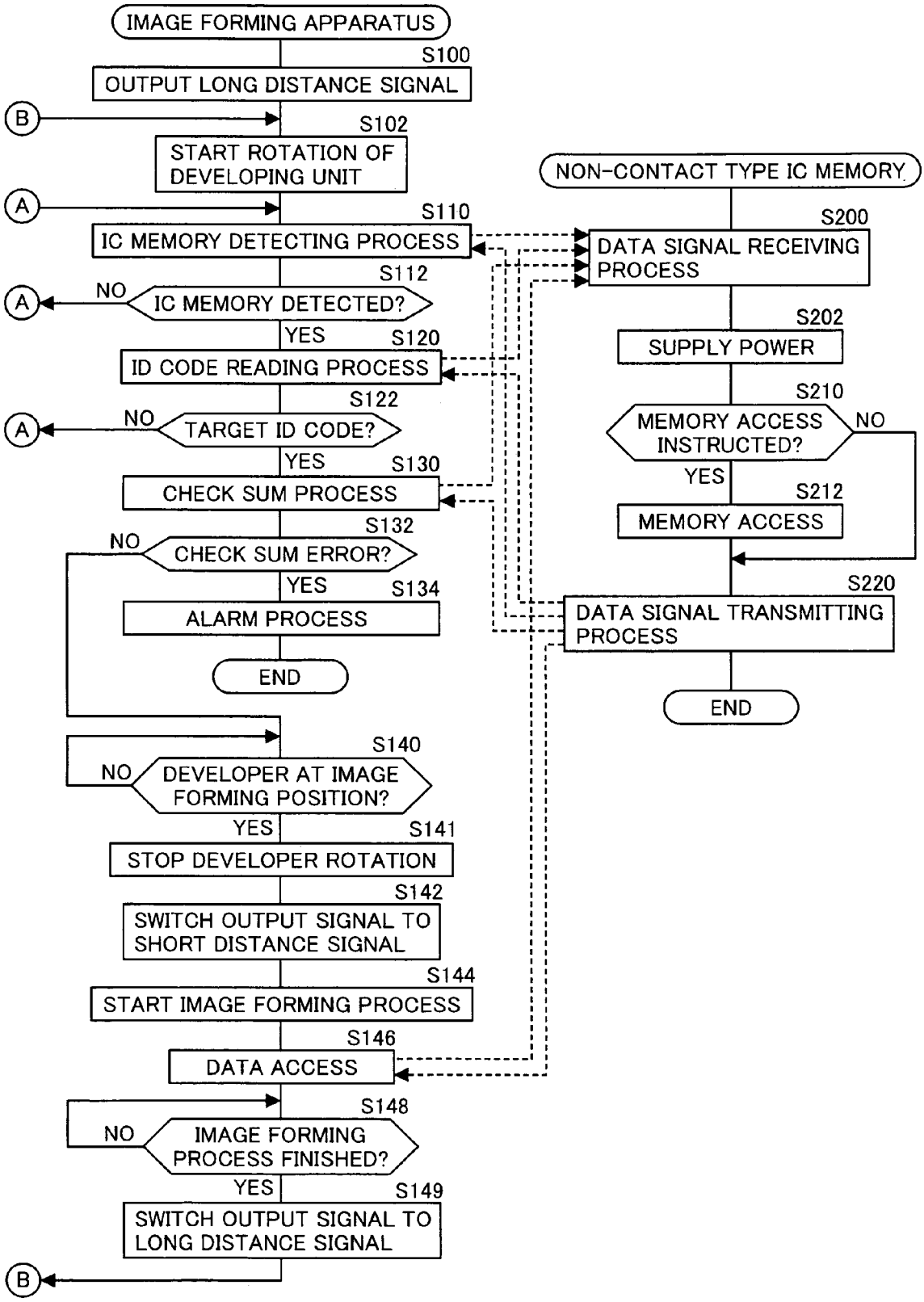
FIG. 6 is a flow chart representing a process executed by the image forming apparatus and the non-contact type IC memory in accordance with the embodiment.

FIG. 6 is a flow chart representing a process executed by the image forming apparatus and the non-contact type IC memory in accordance with the embodiment.

The operation of image forming apparatus 1000 in accordance with the present embodiment will be described with reference to FIGS. 1, 2, 4, 5 and 6. It is assumed that, before the start of the process of step S100 that will be described in the following, the distance between non-contact type IC memory 230C and antenna 505 is as shown in FIG. 5(A). In the following, the distance between IC 230 and antenna 505 at which any of non-contact type IC memories 230C, 230M, 230Y and 230K cannot be detected by the long distance signal from antenna 505 will be referred to as a communication unable distance. In the following, the period in which the IC 230 is at the communication unable distance from antenna 505 will be referred to as a communication unable period.

In step S1100, a process of outputting (transmitting) the long distance signal from antenna 505 is performed. Specifically, control portion 100 outputs a control signal CT to communication control portion 500, to have the long distance signal output from antenna 505.

In response to control signal CT, communication control circuit 502 controls output signal switching circuit 530 such that the long distance signal that has been input to output signal switching circuit 530 is output to transmitting circuit 540. As a result of the above-described operation, the long distance signal is output from antenna 505. Thereafter, the flow proceeds to step S102.

In step S102, under the control of control portion 100, developing units 210C, 210M, 210Y and 210K start clockwise rotation. Then, the flow proceeds to step S110.

In step S1110, an IC memory detecting process is performed to detect non-contact type IC memory 230C. Specifically, the long distance signal transmitted from antenna 505 is received by non-contact type IC memory 230C, and in response, the signal transmitted from non-contact type IC memory 230C is received by antenna 505. Then, the flow proceeds to step S112.

In the following, the process performed by the side of non-contact type IC memory 230C will be described in detail. In the following, the distance between IC 230 and antenna 505 at which any of non-contact type IC memories 230C, 230M, 230Y and 230K can be detected by the long distance signal from antenna 505 is also referred to as a communicable distance. The process described below is performed when the distance between IC 230 and antenna 505 is as shown in FIG. 5(B) (communicable distance). Further, in the following, the period in which the distance between IC 230 and antenna 505 is shorter than the communicable distance will be referred to as a communicable period.

In step S200, a data signal receiving process is performed. Here, the signal (long distance signal) output from antenna 505 is received by antenna 238. Then, the flow proceeds to step S202.

In step S202, as the signal (long distance signal) is received by antenna 238, an electromotive force is generated, which electromotive force is rectified/smoothed by rectifying/smoothing circuit 236 to provide a constant voltage, whereby a voltage (power) is supplied to CPU 231, ROM 232 and EEPROM 233. Then, the flow proceeds to step S210.

In step S210, CPU 231 determines whether the received long distance signal includes an instruction to access to EEPROM 233 (in the following, also referred to as a memory access instruction). In the IC memory detecting process, the received long distance signal does not include any memory access instruction, and therefore, the flow proceeds to step S220.

In step S220, data signal transmitting process is performed. In the data signal transmitting process following the IC memory detecting process, simply, a reception acknowledge signal indicating reception of the long distance signal by CPU 231 is transmitted to antenna 505.

In step S112, whether non-contact type IC memory 230C is detected or not is determined. Specifically, whether the reception acknowledge signal transmitted from non-contact type IC memory 230C is received by antenna 505 or not is determined.

In the present embodiment, step S112 is a process step that is performed when the distance between non-contact type IC memory 230C and antenna 505 is the communicable distance, and therefore, it is determined that the reception acknowledge signal transmitted from non-contact type IC memory 230C is received by antenna 505, and the flow proceeds to step S120. If the distance between non-contact type IC memory 230C and antenna 505 is the communication unable distance, the process of step S110 is repeated.

In step S120, an identification code reading process is performed. Specifically, control portion 100 transmits a control signal CT including a memory access instruction to communication control portion 500, to read a unit identification code from non-contact type IC memory 230C. Unit identification code includes cartridge determining information and color information. Receiving the control signal CT including the memory access instruction, communication control portion 500 generates a long distance signal including a memory access instruction to read the unit identification code, and transmits the long distance signal to non-contact type IC memory 230C.

Thereafter, the processes of steps S200 and S202 described above are performed. The processes of steps S200 and S202 are the same as those described above, and therefore, detailed description thereof will not be repeated. Then, the flow proceeds to step S210.

The long distance signal received in step S210 by non-contact type IC memory 230C includes the memory access instruction to read the unit identification code, and therefore, the process proceeds to step S212.

In step S212, CPU 231 reads the unit identification code from EEPROM 233, and using modulating circuit 234 and antenna 238, generates a long distance signal including the unit identification code. Thereafter, the flow proceeds to step S220.

In step S220, the long distance signal generated in step S212 is transmitted to antenna 505. Thereafter, in step S120, control portion 100 receives the unit identification code, as the long distance signal received by antenna 505 is subjected to a signal receiving process by communication control portion 500. Then, the flow proceeds to step S122.

In step S122, whether the unit identification code received by control portion 100 is the target identification code or not is determined. By way of example, when a cyan toner image is to be formed on photoreceptor drum 310 by using cyan (C) toner, whether the received unit identification code is from developing unit 230C or not is determined.

In step S122, if it is determined that the unit identification code received by control portion 100 is not the target identification code, the process of step S110 is repeated. If it is determined in step S122 that the unit identification code received by control portion 100 is the target identification code, the flow proceeds to step S130.

In step S130, a check sum process is performed. The check sum process is to determine whether the transmitted data is the same as the received data, to see if normal communication is possible or not. In this process, a prescribed data (hereinafter also referred to as check data) is written to EEPROM 233 in non-contact type IC memory 230C, and the check data written to EEPROM 233 is read from non-contact type IC memory 230C. Whether the check data transmitted to non-contact type IC memory 230C (hereinafter also referred to as transmitted check data) matches the read check data or not is determined.

In order to write the check data to EEPROM 233 in non-contact type IC memory 230C, control portion 100 transmits a control signal CT including a memory access instruction to write the check data to EEPROM 233, to communication control portion 500. Receiving the control signal CT including a memory access instruction from control portion 100, control portion 500 generates a long distance signal including the memory access instruction to write the check data, and transmits the long distance signal to non-contact type IC memory 230C.

Thereafter, the processes of steps S200 and S202 described above are performed. The processes of steps S200 and S202 are the same as those described above, and therefore, detailed description thereof will not be repeated. Then, the flow proceeds to step S210.

The long distance signal received by non-contact type IC memory 230C in step S210 includes a memory access instruction to write check data to EEPROM 233, and therefore, the flow proceeds to step S212.

In step S212, CPU 231 writes the check data to EEPROM 233, the written check data is read from EEPROM 233, and a long distance signal including the read check data is generated using modulating circuit 234 and antenna 238. Then, the flow proceeds to step S220.

In step S220, the long distance signal generated in step S212 is transmitted to antenna 505. Thereafter, in step S130, control portion 100 receives the read check data, as the long distance signal received by antenna 505 is subjected to the signal receiving process by communication control portion 500. Then, the flow proceeds to step S132.

In step S132, control portion 100 determines whether the transmitted check data matches the received check data or not. If it is determined in step S132 that the transmitted check data matches the received check data, the flow proceeds to step S140. If it is determined in step S132 that the transmitted check data does not match the received check data, the flow proceeds to step S134.

In step S134, IC memory trouble warning is given on a display portion or the like (not shown) provided on image forming apparatus 1000 indicating the state of image forming apparatus 1000. Thereafter, the operation of image forming apparatus ends.

In step S140, control portion 100 determines whether developing member 220C rotating under the control of control portion 100 is at the image forming position or not. If it is determined in step S140 that developing member 220C is at the image forming position, the flow proceeds to step S141. When developing member 220C is at the image forming position, the distance between non-contact type IC memory 230C and antenna 505 is as shown in FIG. 5(C) (hereinafter also referred to as image forming distance). The image forming distance is shorter than the communicable distance.

If it is determined in step S140 that developing member 220C is not at the image forming position, the process of step S140 is repeated until the rotating developing member 220C reaches the image forming position.

In step S141, control portion 100 stops rotation of developing rack 200. Specifically, developing member 220C stops at the image forming position. Consequently, non-contact type memory 230C also stops. Then, the process of step S142 is performed.

In step S142, a process for switching the signal transmitted from antenna 505 from long distance to short distance signal is performed. Specifically, control portion 100 outputs to communication control portion 500 a control signal CT for switching the signal transmitted from antenna 505 from the long distance signal to the short distance signal.

In response to the control signal CT, communication control circuit 502 controls output signal switching circuit 530 such that the short distance signal input to output signal switching circuit 530 is output to transmitting circuit 540. As a result of this operation, the signal transmitted from antenna 505 is switched from the long distance signal to the short distance signal. Then, the flow proceeds to step S144.

In step S144, an image forming process starts. The image forming process refers to the series of operations including the charging process, latent electrostatic image forming process, toner image forming process and intermediate transfer process described above. As a result of the image forming process, an image is transferred to (formed on) the surface of photoreceptor drum 310 and to the surface of intermediate transfer belt 430, and therefore, the image forming process is also referred to as the image forming operation. In the image forming process (operation), a high-voltage is supplied from high-voltage supplying portion 400. Then, the flow proceeds to step S146.

In step S146, data access process is performed. The data access process refers to a process of writing the developing unit information described above to EEPROM 233 in non-contact type IC memory 230C, or a process of reading the information stored in EEPROM 233 in non-contact type IC memory 230C.

First, the process of writing the developing unit information described above to EEPROM 233 in non-contact type IC memory 230C will be described.

Control portion 100 transmits to communication control portion 500 a control signal CT including a memory access instruction to write the developing unit information to EEPROM 233. Receiving the control signal CT including a memory access instruction from control portion 100, communication control portion 500 generates a short distance signal including the memory access instruction to write the developing unit information, and transmits the short distance signal to non-contact type IC memory 230C.

Thereafter, the processes of steps S200 and S202 described above are performed. The processes of steps S200 and S202 are the same as those described above, and therefore, detailed description will not be repeated. Then, the flow proceeds to step S210.

In step S210, the short distance signal received by non-contact IC memory 230 includes the memory access instruction to write the developing unit information to EEPROM 233, and therefore, the flow proceeds to step S212.

In step S212, CPU 231 writes the developing unit information to EEPROM 233. When the process for writing the developing unit information to EEPROM 233 ends, a short distance signal including data notifying the end of writing is generated utilizing modulating circuit 234 and antenna 238. Thereafter, the flow proceeds to step S220.

In step S220, the short distance signal generated in step S212 is transmitted to antenna 505. Thereafter, in step S146, communication control portion 500 performs a signal receiving process on the short distance signal received by antenna 505, whereby control portion 100 receives the data notifying the end of writing. Then, the flow proceeds to step S148.

Next, the process of reading the information stored in EEPROM 233 of non-contact type IC memory 230C will be described.

Control portion 100 transmits to communication control portion 500 a control signal CT including a memory access instruction to read the information stored in EEPROM 233. Receiving the control signal CT including a memory access instruction from control portion 100, communication control portion 500 generates a short distance signal including the memory access instruction to read the information stored in EEPROM 233, and transmits the short distance signal to non-contact type IC memory 230C.

Thereafter, the processes of steps S200 and S202 described above are performed. The processes of step S200 and S202 are the same as those described above, and therefore, detailed description will not be repeated. Then, the flow proceeds to step S210.

In step S210, the short distance signal received by non-contact IC memory 230C includes the memory access instruction to read the information stored in EEPROM 233, and therefore, the flow proceeds to step S212.

In step S212, CPU 231 reads from EEPROM 233 the information stored therein. When the process for reading the information stored in EEPROM 233 ends, a short distance signal including data notifying the end of reading is generated utilizing modulating circuit 234 and antenna 238. Thereafter, the flow proceeds to step S220.

In step S220, the short distance signal generated in step S212 is transmitted to antenna 505. Thereafter, in step S146, communication control portion 500 performs a signal receiving process on the short distance signal received by antenna 505, whereby control portion 100 receives the data notifying the end of reading. Then, the flow proceeds to step S148.

In step S148, control portion 100 determines whether the image forming process has been finished. If it is determined in step S148 that the image forming process has been finished, then the flow proceeds to step S149. At the end of image forming process, supply of the high-voltage from high-voltage supplying portion 400 is stopped. If it is determined in step S148 that the image forming process has not been finished, the process of step S148 is repeated.

In step S149, the process of switching the signal transmitted from antenna 505 from a short distance signal to a long distance signal is performed. Specifically, control portion 100 outputs a control signal CT for switching the signal transmitted from antenna 505 from a short distance signal to a long distance signal, to communication control portion 500.

In response to control signal CT, communication control circuit 502 controls output signal switching circuit 530 such that the long distance signal input to output signal switching circuit 530 is output to transmitting circuit 540. As a result of this operation, the signal transmitted from antenna 505 is switched from the short distance signal to the long distance signal. Thereafter, the process of step S102 is repeated.

The processes of steps S102 to S149 and S200 to S220 described with reference to non-contact type IC memory 230C are also performed for each of non-contact type IC memories 230M, 230Y and 230K.

As described above, image forming apparatus 1000 in accordance with the present embodiment is capable of stable wireless communication, as a short distance signal less susceptible to noise is used during the image forming process in which a high-voltage is supplied from high-voltage supplying portion 400.

In image forming apparatus 1000 of the present embodiment, wireless communication is performed using the long distance signal having longer communication length other than in the image forming process, and therefore, it is possible to quickly detect the non-contact type IC memory 230 that is rotating. Thus, longer time for wireless communication is ensured.

Next, an interrupting process, which is performed when a process of writing additional data to non-contact type IC memory 230 or a data back-up process for the data stored in non-contact type IC memory 230 becomes necessary, will be described. The interrupting process is performed during communicable period not performing the image forming process.

Figure 7:
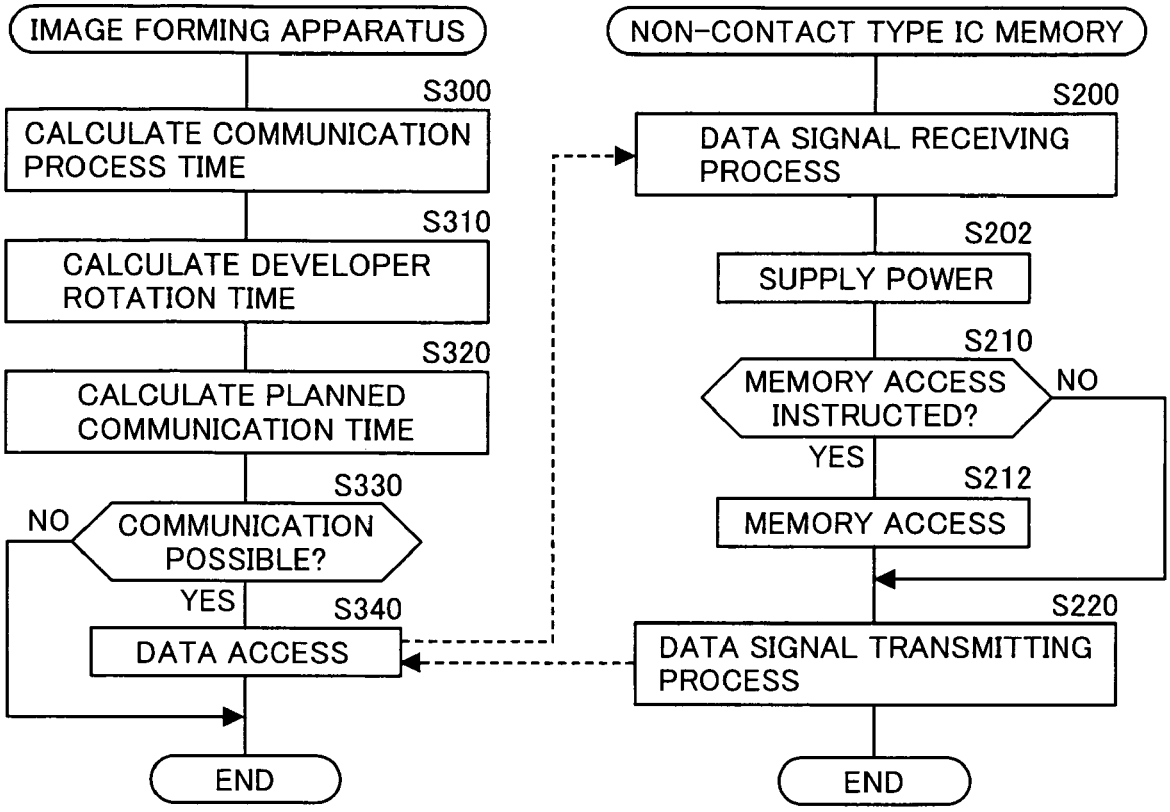
FIG. 7 is a flow chart representing an interruption process executed by the image forming apparatus and the non-contact type IC memory in accordance with the embodiment.

FIG. 7 is a flow chart representing an interruption process executed by the image forming apparatus and the non-contact type IC memory in accordance with the embodiment.

Referring to FIG. 7, in step S300, control portion 100 calculates time necessary for the wireless communication process (hereinafter also referred to as wireless communication time). The wireless communication time T is represented by the following equation (1).

$$T=K\times N+M \tag{1}$$

Here, K in equation (1) represents a communication coefficient, which is, by way of example, 1.3. N represents the number of pages when data is transmitted by the unit of a "page". Here, N is, by way of example, 9. M represents a command response process time. The command response process time is the sum of the time in which a command is transmitted by the operation of control portion 100 and communication control portion 500 to non-contact type IC memory 230 and the time in which the data transmitted from non-contact type IC memory 230 is received by control portion 100. By way of example, M is 50 (ms). When the values K=1.3, N=9 and M=50 are input to equation (1), T=1.3×9+50=61.7 (ms). Next, the flow proceeds to step S310.

In step S310, control portion 100 calculates the rotation time of the developing member. The rotation time RT of the developing member corresponds to the time from when rotation of developing unit 210 is started by control portion 100 until the process of step S300 is completed. That is, the time from the start of rotation of developing unit until the start of calculation of rotation time of the developing member. The rotation time RT of the developing member is assumed, by way of example, to be 20 (ms). Thereafter, the flow proceeds to step S320.

In step S320, control portion 100 calculates planned communication time PT. The planned communication time PT is calculated in accordance with equation (2) below.

$$PT=T+RT$$

When T=61.7 and RT=20 are input to equation (2), PT will be PT=61.7+20=81.7 (ms). Thereafter, the flow proceeds to step S330.

In step S330, control portion 100 determines whether wireless communication is possible or not, based on the planned communication time PT. Specifically, whether the planned communication time PT is not longer than the pre-set maximum communicable time or not is determined. The maximum communicable time MAXT is pre-set in accordance with speed of rotation of the developing member and the like. Here, the maximum communicable time MAXT is assumed to be 100 (ms). Control portion 100 determines whether wireless communication is possible or not, and therefore, it is also referred to as a communication determining portion.

Here, MAXT (100)≧PT (81.7), and therefore, it is determined in step 330 that wireless communication is possible, and the process proceeds to step S340.

When MAXT<PT, it is determined in step S330 that wireless communication is impossible, and the process ends.

In step S340, a data access takes place. Here, by way of example, a back-up process for the data stored in non-contact type IC memory 230, that is, the process of reading information stored in EEPROM 233 of non-contact IC memory 230C, will be described.

Control portion 100 transmits to communication control portion 500 a control signal CT including a memory access instruction to read the information stored in EEPROM 233: Receiving the control signal CT including a memory access instruction from control portion 100, communication control portion 500 generates a long distance signal including the memory access instruction to read the information stored in EEPROM 233, and transmits the long distance signal to non-contact type IC memory 230C.

Thereafter, the processes of steps S200 and S202 described above are performed. The processes of steps S200 and S202 are the same as those described above, and therefore, detailed description will not be repeated. Then, the flow proceeds to step S210.

In step S210, the long distance signal received by non-contact IC memory 230C includes the memory access instruction to read the information stored in EEPROM 233, and therefore, the flow proceeds to step S212.

In step S212, CPU 231 reads from EEPROM 233 the information stored therein. When the process for reading the information stored in EEPROM 233 ends, a long distance signal including data notifying the end of reading is generated utilizing modulating circuit 234 and antenna 238. Thereafter, the flow proceeds to step S220.

In step S220, the long distance signal generated in step S212 is transmitted to antenna 505. Thereafter, in step S340, communication control portion 500 performs a signal receiving process on the long distance signal received by antenna 505, whereby control portion 100 receives the data notifying the end of reading. Thus, the interrupting process ends.

The process of writing additional data to non-contact type IC memory 230 is the same as the process of writing the developing unit information to EEPROM 233 of non-contact type IC memory 230C described above. Specifically, the processes performed in steps S340, S200, S202, S210, S212 and S220 are the same as the process of writing the developing unit information to EEPROM 233 of non-contact type IC memory 230C except that a long distance signal is used in place of the short distance signal. Therefore, detailed description thereof will not be repeated.

As described above, in the image forming apparatus 1000 in accordance with the present embodiment, in the communicable period in which the image forming process is not performed, that is, the period in which a high-voltage is not supplied from high-voltage supplying portion 400 and therefore influence of noise is small, is effectively utilized to perform wireless communication.

Though a 4-cypcle type color printer has been described in the present embodiment, the present invention is not limited thereto. By way of example, the present invention is also applicable to other image forming apparatus such as a 4-cycle type color copying machine or a facsimile.

Though a color printer using four colors of C, M, Y and K has been described in the present embodiment, the present invention is not limited thereto. For example, the present invention may be applied to an image forming apparatus using two or six colors.

Though the IC memory is mounted on the developing unit in the present embodiment, the present invention is not limited thereto. The present invention is applicable even when the member on which the IC memory is mounted is any member that moves on a prescribed track along with the image forming operation.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

a unit, moving in response to an image forming operation, for forming an image;

a non-contact type data storage circuit provided corresponding to said unit and moving with said unit; and a communication control portion communicating with said non-contact type data storage circuit and controlling data-access to said non-contact type data storage circuit; wherein said communication control portion communicates during an image forming operation with said non-contact type data storage circuit with a communication signal having a first percentage modulation, and communicates during a non-image forming operation with said non-contact type data storage circuit with a communication signal having a second percentage modulation smaller than said first percentage modulation, so as to attain data-access to said non-contact type data storage circuit.

2. The image forming apparatus according to claim 1, further comprising an image forming voltage generating portion generating an image forming voltage used for image formation; wherein said unit includes a developing member for forming an image utilizing said image forming voltage in an image forming operation.

3. The image forming apparatus according to claim 1, wherein said unit moves not in the image forming operation, and stops at a prescribed position in said image forming operation.

4. The image forming apparatus according to claim 1, further comprising a communication determining portion determining, based on a communication process time calculated from an amount of data communicated between said communication control portion and said non-contact type data storage circuit and an available communication time calculated based on the speed of movement of said non-contact type data storage circuit, whether communication of said amount of data is possible or not; wherein when said communication determining portion determines that a communication is possible, said communication control portion communicates with said non-contact type data storage circuit by said communication signal of the second percentage modulation, to attain data-access to said non-contact type data storage circuit.

5. The image forming apparatus according to claim 1, wherein said communication signal is an amplitude-modulated signal.

6. The image forming apparatus according to claim 5, wherein said first percentage modulation is 100% and said second percentage modulation is 10%.

7. An image forming apparatus, comprising:

a unit, moving in response to an image forming operation, for forming an image;

a non-contact type data storage circuit provided corresponding to said unit and moving with said unit;

a communication control portion communicating with said non-contact type data storage circuit and controlling data-access to said non-contact type data storage circuit; and a high-voltage supplying portion supplying a high-voltage for forming an image to said unit; wherein said communication control portion communicates with said non-contact type data storage circuit by a communication signal of a first percentage modulation when said high-voltage supplying portion is supplying a high-voltage to said unit, and communicates with said non-contact type data storage circuit by a communication signal of a second percentage modulation smaller than said first percentage modulation when said high-voltage supplying portion does not supply any high-voltage to the unit, so as to attain data-access to said non-contact type data storage circuit.

8. The image forming apparatus according to claim 7, wherein said communication signal is an amplitude-modulated signal.

9. The image forming apparatus according to claim 8, wherein said first percentage modulation is 100% and said second percentage modulation is 10%.

10. An image forming apparatus comprising:

a developing apparatus for forming an image, said developing apparatus including a plurality of developing units corresponding to a plurality of colors for forming a color image respectively, and moving each of said developing units for successively stopping each of said developing units at a prescribed image forming position;

a non-contact type IC memory provided corresponding to each said developing unit and moving with the movement of said developing unit;

a high-voltage supplying portion supplying a high-voltage for development to any of said plurality of developing units when stopped at said image forming position;

a communication portion provided to be close to said non-contact type IC memory corresponding to the developing unit being stopped at said image forming position; and a communication control portion controlling communication such that when a high-voltage is being applied by said high-voltage supplying portion to the developing unit which is stopped at the image forming position, communication with said non-contact IC memory is established by a communication signal of a first percentage modulation using said communication portion and when a high-voltage is not being applied by said high-voltage supplying portion to the developing unit which is stopped at the image forming position, communication with said non-contact IC memory is established by a communication signal of a second percentage modulation smaller than said first percentage modulation, using said communication portion.

* * * * *